United States Patent [19]

Worsey

[11] Patent Number: 4,754,705

[45] Date of Patent: Jul. 5, 1988

[54] MECHANICAL STEMMING CONSTRUCTION FOR BLAST HOLES AND METHOD OF USE

[75] Inventor: Paul N. Worsey, Rolla, Mo.

[73] Assignee: The Curators of the University of Missouri, Columbia, Mo.

[21] Appl. No.: 930,917

[22] Filed: Nov. 17, 1986

[51] Int. Cl.[4] ..... F42B 13/44; F42D 3/00

[52] U.S. Cl. ..... 102/333; 102/312; 102/313; 102/331

[58] Field of Search ..... 102/331, 333, 312, 313

[56] References Cited

U.S. PATENT DOCUMENTS

| | | | |
|---|---|---|---|
| 155,731 | 10/1874 | Kalmbach | 102/30 |
| 1,131,876 | 10/1913 | Tietig | 102/30 |
| 2,403,386 | 7/1946 | Lubelsky et al. | 102/30 |
| 2,646,845 | 7/1953 | Schillinger | 102/333 X |
| 2,876,700 | 3/1959 | Householder | 102/333 |
| 2,995,087 | 8/1961 | Edney et al. | 102/30 |
| 3,151,556 | 10/1964 | Karpovitch | 102/333 |
| 3,173,368 | 3/1965 | Griffith et al. | 102/333 |
| 3,366,056 | 1/1968 | Thunell et al. | 102/333 |
| 3,608,491 | 9/1971 | Botes | 102/333 |
| 3,954,058 | 5/1976 | Sanders et al. | 102/30 |
| 4,449,754 | 5/1984 | Orlov et al. | 102/333 X |
| 4,470,352 | 9/1984 | Leperre | 102/333 |
| 4,572,075 | 2/1986 | Day et al. | 102/333 X |

FOREIGN PATENT DOCUMENTS

| | | | |
|---|---|---|---|
| 1168059 | 12/1958 | France | 102/333 |

*Primary Examiner*—Peter A. Nelson

*Attorney, Agent, or Firm*—Senniger, Powers, Leavitt and Roedel

[57] ABSTRACT

A stemming construction for a blast hole loaded with an explosive charge, comprising a tapering wedge member dispersed in the blast hole outwardly of the explosive charge with its narrower end facing outwardly toward the mouth of the blast hole, and particulate stemming material in the blast hole outwardly of the wedge member. Detonation of the explosive drives the wedge member into the stemming material to wedge the stemming material against the walls of the blast hole. The wedge member is preferably cone-shaped and can be provided with a stabilizing rod to prevent it from tilting.

21 Claims, 1 Drawing Sheet

MECHANICAL STEMMING CONSTRUCTION FOR BLAST HOLES AND METHOD OF USE

BACKGROUND OF THE INVENTION

This invention relates to a mechanical stemming construction for explosive loaded blast holes and a method of using such a construction.

Blasting is used in construction and mining to fragment solid rock so that it can be removed. A number of blast holes are drilled and filled with explosive charges which are detonated to produce shock waves that rupture the surrounding rock. There are a number of parameters that govern the effectiveness of a blast, including geologic structure, the size and spacing of the blast holes, the burden (distance to the free face), the type, amount, and placement of explosive, the sequence of detonation, and the stemming technique used.

Stemming is the plugging of the blast hole to prevent the escape of blast gases. This is important because the blast gases perform the primary work of the blast. If the blast gases escape, the effectiveness of the blast is diminished, wasting explosive and requiring additional blasting which entails additional risk and increased drilling, labor, and material costs. Stemming is also important because escaping gases create an overpressure or air concussion causing objectionable noise and possibly causing personal injury or property damage.

Present stemming techniques simply involve filling the blast hole with material. Stemming resists the blast forces because of the inertia of the stemming material, bridging of the stemming material which resists flow, and friction of the stemming material against the blast hole walls. Angular particles are particularly suitable as stemming material because they readily bridge.

With present stemming techniques, the length of the hole required for stemming is sometimes so great that less than an optimum explosive charge may have to be used. This may be the case, for example, in surface blasting in the vicinity of human habitations, or where for geologic or other reasons the blast hole must be kept short. Furthermore, stemming can be expensive and time-consuming, especially where a special stemming material, such as angular rock fragments in a particular size range, is required. Inadequate stemming can lead to "blow outs" where the stemming material is ejected from the hole, which can cause personal injury or property damage.

SUMMARY OF THE INVENTION

Among the several objects of this invention may be noted the provision of a stemming construction that more effectively blocks the blast hole; the provision of such a stemming construction that achieves more effective blasting; the provision of such a stemming construction that uses shorter lengths of stemming material; and the provision of such a stemming construction that is inexpensive, easy to install, and does not require special stemming materials.

The stemming construction of this invention is adapted for use in a blast hole having an explosive charge therein. Generally, the construction comprises a tapering wedge member positioned in the blast hole outwardly of the explosive charge, with its narrower end facing outwardly toward the mouth of the hole. Particulate stemming material is disposed in the blast hole outwardly of the wedge member. The wedge member is adapted to be driven into the stemming material to wedge the stemming material laterally against the walls of the blast hole, upon detonation of the explosive charge.

The method of this invention generally involves inserting a tapering wedge member into an explosive-loaded blast hole with the narrower end of the wedge member facing outwardly with respect to the hole. A particulate stemming material is then placed in the blast hole outwardly of the wedge member.

The wedge member is preferably cone-shaped, with a flat base extending substantially across the blast hole. The wedge member may also have an indented base, for example, with a conical or hemispherical indentation so that the force of the blast will force the edges of the wedge member outwardly to better seal the bore. The wedge member can be made from a shock and heat resistant plastic. The wedge member may be provided with a stabilizing rod extending axially from the wedge member. The rod facilitates installation and, when surrounded by stemming material, helps to stabilize the wedge member, preventing it from tilting. A notch or passage may be constructed in the wedge member to accommodate wires extending between the firing device and the explosive charge. The stemming material preferably comprises an inner layer of fine stemming material outwardly of the wedge member, and an outer layer of coarser stemming material outwardly of the inner layer.

The stemming construction of this invention is more effective than stemming material alone. The construction thus provides more efficient blasting and reduces the incidence of "blow-outs" where the stemming material is propelled from the blast hole. It is estimated that the construction may reduce the length of stemming needed by as much as 25%. The construction is simple, inexpensive, and it can be used with ordinary stemming materials. These and other advantages will be more apparent with reference to the preferred embodiment described below.

DETAILED DESCRIPTION OF THE PREFERRED EMBODIMENT

Figure 1:
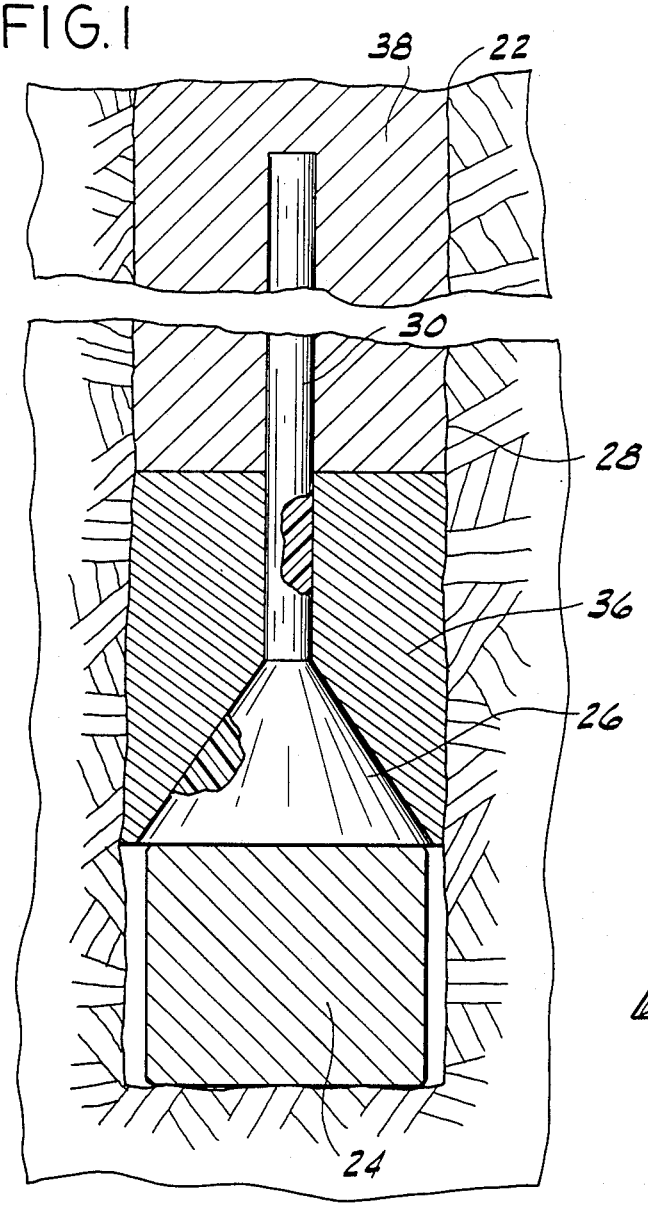
FIG. 1 is a side elevation view of a stemming construction according to this invention as it would be installed in a blast hole.

A stemming construction according to the principles of this invention is shown in FIG. 1 as it would be installed in a blast hole 22 having an explosive charge 24 therein. Charge 24 is shown for schematic purposes only and may vary in size or shape. In addition, various detonators (not shown) may be provided as necessary. The stemming construction comprises a tapering wedge member 26 positioned in the blast hole 22 outwardly of (e.g., above) the explosive charge 24, with its narrower end facing outwardly toward the mouth of the blast hole. A protective layer such as an air gap or a layer of stemming material can be interposed between the wedge member and the explosive charge to preserve the wedge member from the blast forces. Particulate stemming material 28 is loaded in blast hole 22 outwardly of the wedge member 26. Thus, detonation of the explosive charge in blast hole 22 drives wedge member 26 into the stemming material 28 to wedge the material against the walls of blast hole 22. Wedge member 26 also helps to promote bridging between the particles comprising the stemming material 28.

Figure 4:
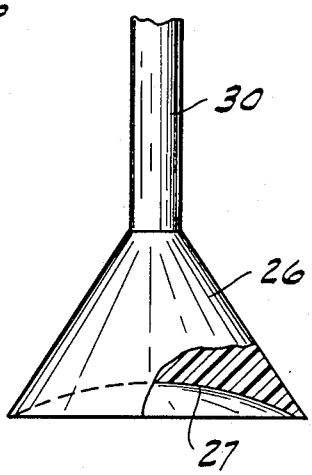
FIG. 4 is a side elevation view of an alternative construction of the wedge member with a portion broken away to show an indentation in the bottom.

The wedge member 26 is preferably conical in shape, although some other shape such as frustoconical, pyramidal, or frustopyramidal can be used. The angle of taper of wedge member 26 is preferably such that the axial component of the force applied by the wedge member 26 to the stemming material on detonation of charge 24 is less than the friction force of the stemming material against the blast hole walls resulting from the applied force. The angle of taper of the cone is preferably between about 30° and about 60° with respect to the base. Wedge member 26 may have a flat base to help prevent the force of the blast from tilting wedge member 26, or, as shown in FIG. 4 the bottom of the wedge member may have an indentation 27. This indentation may be conical, hemispherical, or some other shape and facilitates the flaring of the edges of the wedge shaped member to seal with the blast hole walls.

As shown in the drawings, wedge member 26 includes a stabilizing rod 30 extending endwise from the narrow end of the wedge member 26, and generally axially of the blast hole. The stabilizing rod is surrounded by stemming material 28 and therefore resists forces tending to tilt wedge member 26. Rod 30 also functions as a handle to facilitate installation of the wedge member in blast hole 22. Preferably, the wedge member 26 is cone-shaped and the stabilizing rod 30 extends from the apex of the cone. The length of the rod is preferably seven to ten times the diameter of the blast hole. The rod may also be provided with discs (not shown) to help center the rod and the wedge member in the blast hole. It will be understood that rod 30 does not have to be included on wedge member 26. Wedge member 26 and rod 30, if there is one, are preferably made from a heat and impact-resistant polymer.

Figure 2:
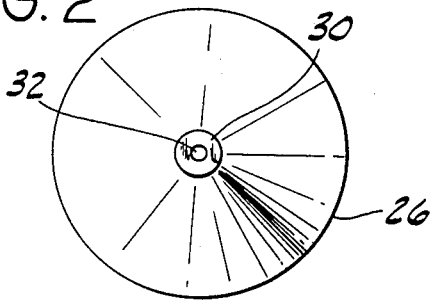
FIG. 2 is a top plan view of a modified embodiment of the wedge member, showing a central aperture for receiving detonation wires.
Figure 3:
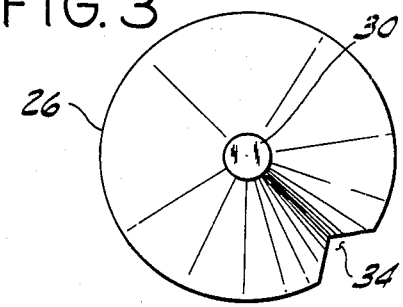
FIG. 3 is a top plan view of a second modified embodiment of the wedge member, showing a peripheral notch for receiving detonation wires.

The wedge member 26 is preferably sized to substantially occupy the cross-sectional area of the blast hole 22. Thus, wedge member 26 helps to block the hole 22 in addition to wedging the stemming material 28. Because of the close fit of wedge member 26 in bore 22, the wedge member can be provided with a central aperture 32, as shown in FIG. 2, or a peripheral notch 34, as shown in FIG. 3, for the passage of detonation wires to the explosive charge 24.

The stemming material 28 can be any particulate substance, but it is preferably one comprised of angular particles. Testing indicates that rounder or more spherical particles are less able to "bridge" together, it being understood that "bridging" is the interlocking of adjacent particles to form a network that resists flow of the material. In the preferred embodiment there are two layers 36 and 38 of stemming material. The inner layer 36 is of a relatively fine particulate material, such as drilling chips. The outer layer 38 is of a relatively larger particulate material.

According to the method of this invention, a blast hole 22 is made and loaded with an explosive charge 24. Firing wires can be passed through a central aperture 32 or a notch 34 in the wedge member 26. The wedge member 26 is then placed in hole 22 with the narrower end facing outwardly (upwardly as viewed in FIG. 1) with respect to the hole. A protective layer may be interposed between the wedge member and the explosive charge to protect the wedge member. Such a protective layer may be, for example, an air gap or a layer of stemming material. An inner layer 36 of relatively fine particulate stemming material is then placed over wedge member 26, and around rod 30. An outer layer 38 of relatively coarser particulate stemming material is placed over the first layer 36 and around rod 30 (if rod 30 extends that far). It is estimated that the length of stemming material required to stem a given blast is reduced by as much as 25% when wedge member 26 is used.

OPERATION

With the stemming construction properly installed in the blast hole, detonation of explosive charge 24 creates blast gases that drive wedge member 26 outwardly (up as viewed in FIG. 1). The wedge member may travel outwardly as much as three times the diameter of the bore. The mere presence and size of wedge member 26 acts to substantially plug hole 22. However, the outward (upward) movement of wedge member 26 compacts the stemming material causing the particles to "bridge" and forces the stemming material laterally against the blast hole walls. Stemming is most important in the milliseconds after the detonation. While the wedge member may continue to travel outwardly and some of the stemming material may even be ejected from the hole, the wedge member and the stemming material effectively plug the blast hole in the critical period immediately after detonation so that the blast gases cannot escape. Consequently, the blast gases act against the surrounding rock causing a more complete fragmentation of the rock and therefore more efficient and effective blasting.

Of course, the stemming construction and method of this invention can also be used in decking wherein several charges separated by stemming material are loaded in the same hole and detonated in succession from the bottom outward toward the mouth. In decking a particular problem has been "dead pressing", which is the diminishment or loss of an explosive's effectiveness caused by the application of pressure on the explosive by the previous blast. The more effective stemming achieved by the present construction and method, helps to reduce "dead pressing".

There are various changes and modifications which may be made to this invention as would be apparent to those skilled in the art. However, any of those changes or modifications are included in the teachings of this disclosure, and it is intended that this invention be limited only by the scope of the claims and appended hereto.

What is claimed is:

1. A stemming construction for a blast hole having an explosive charge therein, comprising:

a tapering wedge member positioned in the blast hole outwardly of the explosive charge with its narrower end facing outwardly toward the mouth of the blast hole; and particulate stemming material in the blast hole disposed outwardly of the wedge member whereby upon detonation of the explosive charge the wedge member is adapted to be driven into the stemming material to wedge the stemming material laterally against the walls of the blast hole.

2. The stemming construction of claim 1 wherein said wedge member is cone-shaped.

3. The stemming construction of claim 2 wherein the wedge member has an indented base such that detonation of the explosive charge can force the edges of the wedge member outward to facilitate sealing the bore.

4. The stemming construction of claim 2 wherein the angle of the taper of the cone is such that the axial component of the force applied by the cone to the stemming material upon detonation of the explosive charge is less than the friction force of the stemming material against the blast hole walls resulting from the applied force.

5. The stemming construction of claim 1 wherein the wedge member is made of plastic.

6. The stemming construction of claim 1 further comprising a stabilizing rod extending endwise from the narrow end of the wedge member generally axially of the blast hole, said rod being surrounded by said stemming material and being adapted to resist forces tending to tilt the wedge member.

7. The stemming construction of claim 6 wherein the tapering wedge is generally cone-shaped and the stabilizing rod extends from the apex of the cone-shaped wedge member.

8. The stemming construction of claim 1 wherein the particulate stemming material comprises an inner layer of fine stemming material disposed outwardly of the wedge member and an outer layer of coarser stemming material disposed outwardly of the inner layer.

9. The stemming construction of claim 1 wherein the stemming material is angular rock fragments.

10. The stemming construction of claim 1 wherein the diameter of the wedge member is only slightly smaller than the diameter of the blast hole.

11. The stemming construction of claim 10 wherein the wedge member further comprises means defining an aperture for receiving wires.

12. The stemming construction of claim 1 further comprising a protective layer between the wedge member and the explosive charge.

13. A wedge member adapted for use in stemming a blast hole having an explosive charge therein, said wedge member having a body with a base tapering to a relatively narrow end, and a stabilizing rod extending endwise from said narrow end of the body, said wedge member being adapted to be positioned in said blast hole, disposed outwardly of the explosive charge, with the narrow end of the wedge member facing outwardly toward the mouth of the blast hole and with said stabilizing rod extending generally axially of the blast hole from the body of the wedge member toward the mouth of the blast hole, whereby upon detonation of the explosive charge the wedge member is adapted to be driven outwardly into stemming material in the blast hole to wedge the stemming material laterally against the walls of the blast hole.

14. A method of stemming a blast hole loaded with an explosive charge comprising the steps of:

inserting a tapering wedge member into the blast hole, with the narrower end of the wedge member facing outwardly with respect to the hole;

placing a particulate stemming material in the blast hole outwardly of the wedge member.

15. The method of claim 14 wherein the wedge member is cone-shaped.

16. The method of claim 15 wherein the angle of the taper of the cone is such that the axial component of the force applied by the cone to the stemming material upon detonation of the explosive charge is less than the friction force of the stemming material against the blast hole walls resulting from the applied force.

17. The method of claim 14 wherein the base of the wedge member is only slightly smaller than the blast hole.

18. The method of claim 14 wherein the step of placing stemming material in the blast hole comprises placing an inner layer of fine stemming material in the blast hole outwardly of the wedge member and placing an outer layer of coarser stemming material in the blast hole outwardly of the inner layer.

19. The method of claim 14 wherein the stemming material is angular rock fragments.

20. The method of claim 14 wherein the wedge member further comprises a stabilizing rod extending endwise from the narrower end of the wedge member, said method further comprising placing stemming material in the blast hole around stabilizing rod.

21. The method of claim 14 further comprises the step of forming a protective layer between the explosive charge and the wedge member.

* * * * *